United States Patent [19]

Wilson et al.

[11] Patent Number: 4,653,831

[45] Date of Patent: Mar. 31, 1987

[54] CONNECTOR HOUSING

[75] Inventors: Bill B. Wilson, Clarendon Hills; Steve Colleran, Lisle, both of Ill.

[73] Assignee: Molex Incorporated, Lisle, Ill.

[21] Appl. No.: 827,311

[22] Filed: Feb. 7, 1986

[51] Int. Cl.[4] ..... H01R 4/24

[52] U.S. Cl. ..... 339/98; 339/103 M

[58] Field of Search ..... 339/97 R, 97 P, 98, 339/99 R, 103 R, 103 M

[56] References Cited

U.S. PATENT DOCUMENTS

| | | | |
|---|---|---|---|
| 3,899,237 | 8/1975 | Briggs, Jr. | 339/99 R |
| 4,178,055 | 12/1979 | Fleischhacker et al. | 339/98 |
| 4,227,763 | 10/1980 | Marks | 339/99 R |

*Primary Examiner*—Joseph H. McGlynn
*Attorney, Agent, or Firm*—Louis A. Hecht; John W. Cornell

[57] ABSTRACT

A multicircuit electrical connector for mass terminating a plurality of insulation-clad wires includes a dielectric housing with a plurality of terminal-receiving cavities formed therein and a wall adjoining the cavities. Wire-receiving regions are formed in the wall, each for receiving a wire moved laterally of its axis into a respective cavity. Improved strain relief means are formed in the housing wall, one adjacent each wire-receiving region. Each strain relief means includes first and second resilient fingers offset from each other along a wire axis and constricting a wire-receiving entrance to a region. The first fingers are mounted to the wall for independent movement relative to their generally opposing second finger, and are independently moveable with respect thereto, as wires are simultaneously introduced into said wire-receiving regions during mass termination in said connector.

7 Claims, 15 Drawing Figures

CONNECTOR HOUSING

BACKGROUND OF THE INVENTION

1. Field of the Invention

The present invention pertains to integrally molded housing for electrical connectors, and in particular to connectors having insulation displacement type terminals mounted therein. More specifically, the present invention pertains to improved strain relief means to prevent the accidental removal of a wire terminated to the connector.

2. Brief Description of the Prior Art

Due to economies of total applied cost, connectors having insulation displacement terminals are becoming increasingly popular. Generally, in these types of connectors a wire is moved laterally of its axis to be received within an insulation displacing terminal. These terminals typically include the pair of opposed insulation severing edges, with a wire-receiving gap therebetween. As the wire is inserted into the gap, the edges sever and displace the insulation, allowing conductive engagement between the terminal edges and the conductor of the insulationclad wire. The terminal is typically associated with an insulated housing having a terminal receiving cavity formed therein, and a wire connecting region adjoining the cavity for receiving a wire moved laterally of its axis into the cavity to be terminated in the terminal. Typically strain relief means are formed on the housing adjacent the wire connecting region to prevent accidental extraction of the wire from the terminal.

One form of strain relief means is disclosed in U.S. Pat. No. 4,178,055, wherein a single resilient finger extends into the wire connecting region to define a constricted wire receiving entrance. The finger is resiliently moveable to allow a wire to pass through the entrance into the cavity for connection to the terminal. To be economically attractive, connector housings must be integrally molded. Those skilled in the molding art will realize that the molding die must include wall-like members extending between the resilient finger and its opposing wall forming the cavity entrance. As connector sizes, and in particular as insulation-clad wire conductor sizes become smaller, the wire-receiving gap defined by the cavity entrance becomes arbitrarily fixed in size. For small wire conductor sizes, this gap may be significantly large compared to the diameter of the insulation-clad wire, and accordingly, effective strain relief may not be provided. Further, the restricted entrance of this particular connector housing is limited in its ability to receive relatively large wire sizes, since only one resilient finger is provided. That is, a wire being inserted through the entrance is allowed passage into the cavity only to the extent allowed by deflection of the sole resilient finger, the opposing entrancedefining member being a rigid extension of the housing wall.

An improvement over the strain relief means described above is provided in a well known connector housing wherein the wirereceiving entrance is defined by a pair of opposed resilient fingers generally converging toward each other to define the constricted wire receiving entrance. In a multicircuit connector, the pair of opposed fingers are arranged in a linear array, side-by-side, in a single row. During reception of a wire in the entrance, both fingers are deflected toward the housing members from which they depend. An improved wire-receiving action is obtained in this housing, since the two resilient fingers are provided to accept a wider range of conductor sizes. However, the thickness of the opposing fingers limit the size of the wire to an amount less than the maximum obtainable, as defined by the dimensions of the terminal receiving cavities (that is, the distance between adjacent walls, extending in the direction of wire length defining the terminal-receiving cavity). Again, wall-like members of the molding die must be provided between each pair of opposed fingers, thereby introducing an arbitrary gap between resilient fingers. As the wire sizes become smaller, this gap becomes significant in size, permitting accidental removal of a terminated wire between the resilient fingers.

Accordingly, it is an object of the present invention to provide effective strain relief means for mass termination insulation displacement type connectors, having integrally molded housings.

Another object of the present invention is to provide improved strain relief means for connector housings of the above described type, in which terminal centerline spacing or progression can remain constant over a range of larger conductor sizes.

It is a further object of the present invention to provide strain relief means of the above-described type wherein wires having diameters corresponding to the lateral distance between adjacent cavity-defining, interterminal walls can be simultaneously mass inserted in the connector.

SUMMARY OF THE INVENTION

These and other objects of the present invention are provided in a multicircuit electrical connector for mass terminating a plurality of insulation-clad wires, said connector including an integrally molded dielectric housing with a plurality of terminal-receiving cavities formed therein, a wall adjoining said cavities, and wire-receiving regions formed in said wall, each for receiving a wire moved laterally of its axis into a respective cavity, terminals mounted in the cavities, each having an insulation-displacing wire termination portion adapted for making electrical connection with said wires, and a plurality of strain relief means formed in the housing wall, one adjacent each wire-receiving region, each including first and second laterally-opposed wire-retaining fingers extending into a wire-receiving region and defining a constricted wire-receiving entrance thereof, said fingers being resiliently moveable to allow a wire to pass through said entrance into the cavity, the first fingers of one wire-receiving region being adjacent the second fingers of an adjacent wire-receiving region. The improvement in said strain relief means wherein each said first finger is offset from said second finger along a wire axis, and means mounting each said first finger to said wall for independent movement relative to an immediately adjacent second finger of an adjacent wire-receiving region, as said wires are mass terminated to said terminals.

BRIEF DESCRIPTION OF THE DRAWINGS

In the drawings, wherein like elements are referenced alike.

DETAILED DESCRIPTION OF THE PREFERRED EMBODIMENT

Figure 1:
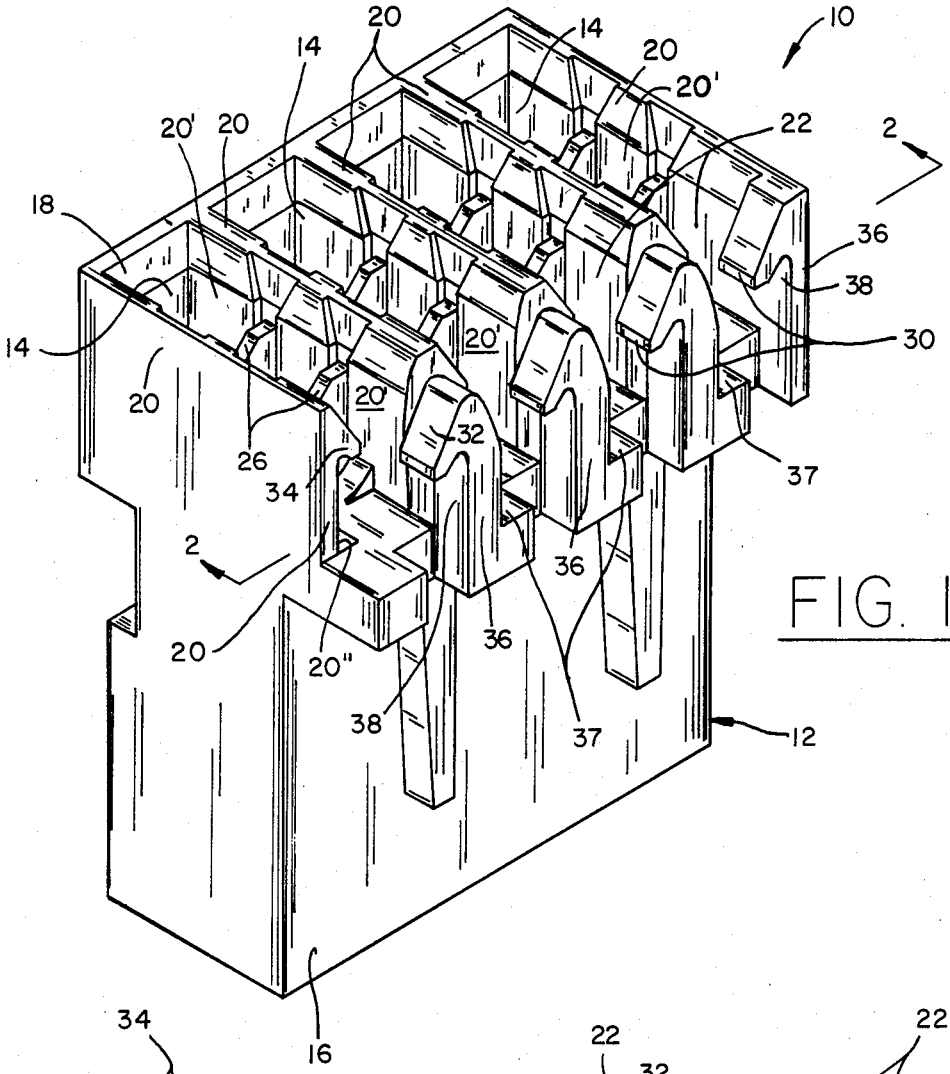
FIG. 1 is a perspective view of a connector housing according to the present invention.
Figure 2:
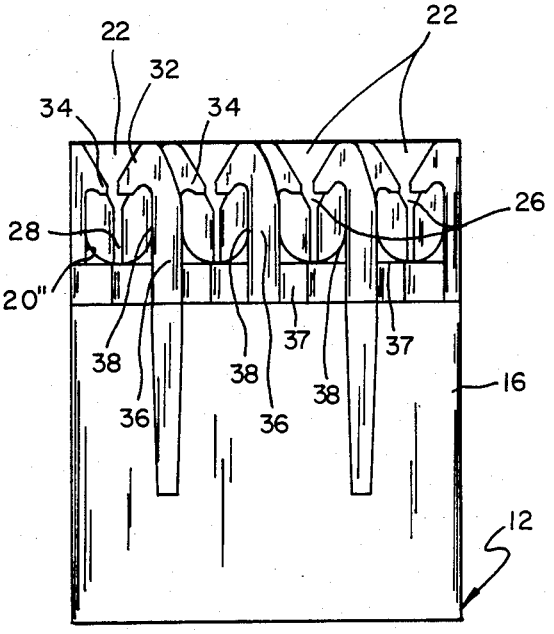
FIG. 2 is an elevational view taken along the lines 2—2 of FIG. 1.

Turning now to the drawings, and especially to FIGS. 1 and 2, a multicircuit electrical connector for mas terminating the conductor portions of a plurality of insulation-clad wires, is indicated generally at 10. Connector 10 includes an integrally molded dielectric housing 12 with a plurality of terminal-receiving cavities 14 formed therein. Housing 12 includes a pair of opposed external walls 16, 18 extending generally transverse to the direction of wire length. A series of inter-terminal walls 20 extend between external walls 16, 18 to define the terminal-receiving cavities 14. As is apparent from the figures, external wall 16 adjoins each of the terminal-receiving cavities 14, and defines a series of wire-receiving regions 22, each for receiving a wire moved laterally of its axis into a respective cavity 14.

Each cavity 14 has mounted therein a terminal 24 having two insulation displacing wire termination portions 26, each comprised of a pair of spaced-apart insulation severing edges, as is known in the art. Wire receiving gaps 28 are defined between each pair of opposed edges.

A plurality of strain relief means 30 are formed in housing 12, one adjacent each wire-receiving region 22. Each strain relief means 30 includes first and second laterally-opposed wire-retaining fingers 32, 34 extending into a wire-receiving region 22 and defining a constricted wire-receiving entrance thereof. Fingers 32, 34 are resiliently moveable to allow a wire to pass through the entrance into a cavity 14. According to the present invention, each first finger 32 is offset from its opposed second finger 34, along a wire axis. First fingers 32 are mounted to external housing wall 16 by an integrally molded resilient cantilever beam 36, so as to be independently moveable relative to its opposed second finger 34, particularly during mass termination of wires in terminals 24. Shelf portions 37 extend laterally from beams 36 to provide support for an adjacent wire, cooperating with the finger 32 of an adjacent cavity. Shelf portions can be extended to completely underlie fingers 32, if desired.

In the preferred embodiment, beams 36 are algined with interterminal walls 20, so as to form axial extensions thereof. Each beam 36 includes a wire engaging surface 38 which is an extension of the wire engaging surface 20′ of wall 20. Resilient fingers 34 depend from wall 20 extending in a direction opposite to surface 20′. Wall 20 includes a wire engaging surface 20″ immediately below each finger 34, for engaging an insulation-clad wire. Thus, each wire, when inserted in connector 10, is received between two opposed housing surfaces.

Figure 7:
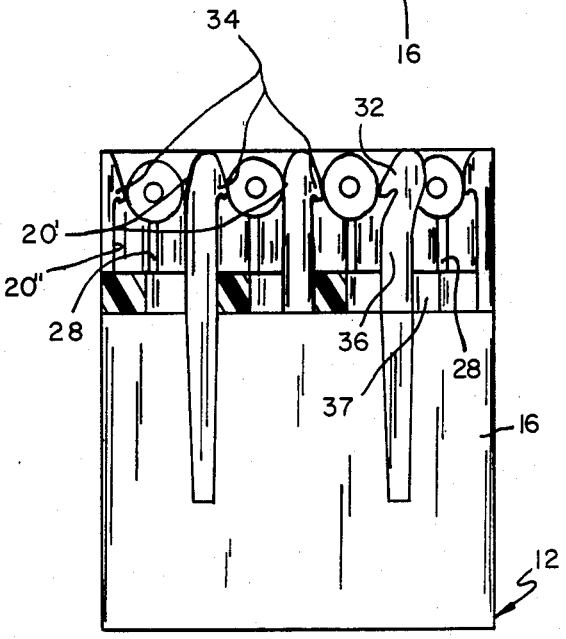
FIG. 7 is an elevational view taken along the lines 7–7 of FIG. 5b.

With additional reference to FIG. 7, one side of the wire (the left side in the figures) is engaged by housing surface 20″. The other opposing side of the wire is engaged by wall surface 20′ and by beam surface 38 which is formed as an extension of surface 20′. Also, in the preferred embodiment, all first fingers 32 lie in one plane, and all second fingers lie in a second spaced-apart plane. This provides a compact, efficiently moldable configuration.

The strain relief means of the present invention, unlike prior art arrangements, provides a restricted wire receiving entrance, but does not limit the lateral size of the the wire-receiving gap defined by adjacent walls 20. These features become important during mass termination, when all strain relief fingers are simultaneously deflected. In the preferred embodiment, first fingers 32 are independently moveable with respect to second fingers 34, providing the maximum wire-receiving capability defined by housing 12. That is, wires up to the size defined by the spacing between opposed wall surfaces 20′, 20″ may be accommodated by the present invention, owing to the independent mounting of first finger 32, as will be further described with reference to FIGS. 3–6.

Figure 3:
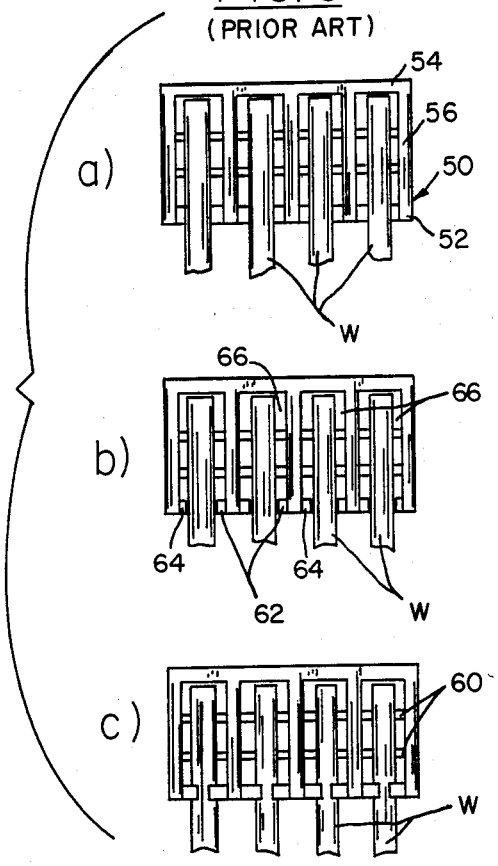
FIG. 3 (PRIOR ART)
FIGS. 3a–3c are a sequence of plan views showing termination of insulation-clad wires in a prior art connector housing.
Figure 4:
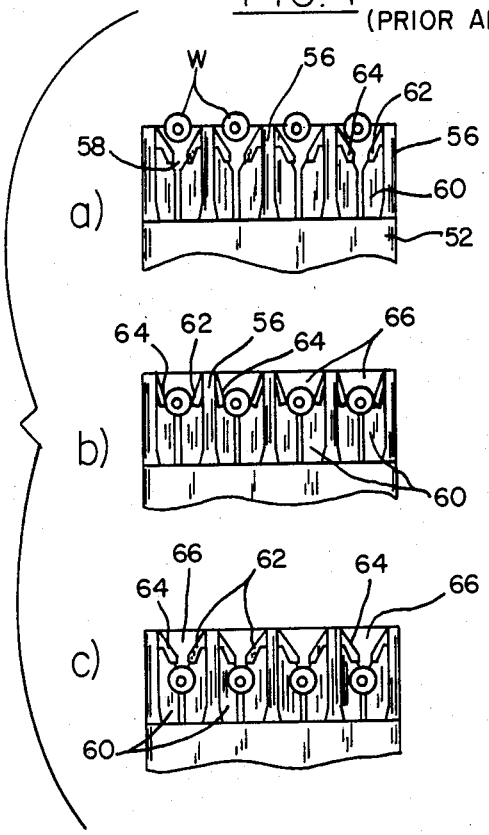
FIG. 4 (PRIOR ART)
FIGS. 4a–4c are elevational views corresponding to FIGS. 3a–3c, respectively.

FIGS. 3a–3c show a wire termination sequence in a prior art connector having a housing 50. FIGS. 4a–4c are elevational views corresponding to FIGS. 3a–3c, respectively. With reference to FIGS. 3 and 4, housing 50 includes a pair of opposed external walls 52, 54 extending generally transverse to the direction of wire length. Inter-terminal walls 56 define a plurality of terminal-receiving cavities 58. Insulation-displacement type terminals 60 are mounted in cavities 58 and include wire-receiving gaps defined by opposed insulation severing edges which sever and displace the insulation of insulation-clad wires received therein. A plurality of strain relief means is formed in housing 52, each including first and second laterally-opposed wire-retaining fingers 62, 64 extending into a wire-receiving region 66, and defining a constricted wire-receiving entrance thereof. Fingers 64, 64 are resiliently moveable to allow an insulation-clad wire "W" to pass through the entrance into cavity 58. The fingers 62, 64 of prior art connector 50 are all arranged in a linear array, in side-by-side opposing relationship. Thus, upon mass insertion of wires in connector 50, the thickness of fingers 62, 64 is added to the thickness of inter-terminal walls 56 from which they depend, as seen most clearly in FIG. 4b. In effect, the size of the terminal receiving cavity 58 (the distance between adjacent walls 56) is reduced by an amount equal to the combined thickness of fingers 62, 64. Wires larger than this reduced size cannot be mass inserted in connector 50, since all fingers of the strain relief means, and possibly all walls 56, are simultaneously deflected.

Further, as indicated in either FIGS. 4a or 4c, a gap exists between each pair of opposed strain relief fingers 62, 64, owing to the necessity of providing tooling steel between those fingers during molding of the connector housing. Thus, as the centerline spacing or progression of terminals 60 remains constant, and the size of the wires "W" is decreased, the gap between adjacent fingers becomes significantly large, presenting a risk of accidental withdrawal of a terminated wire therethrough.

Figure 5:
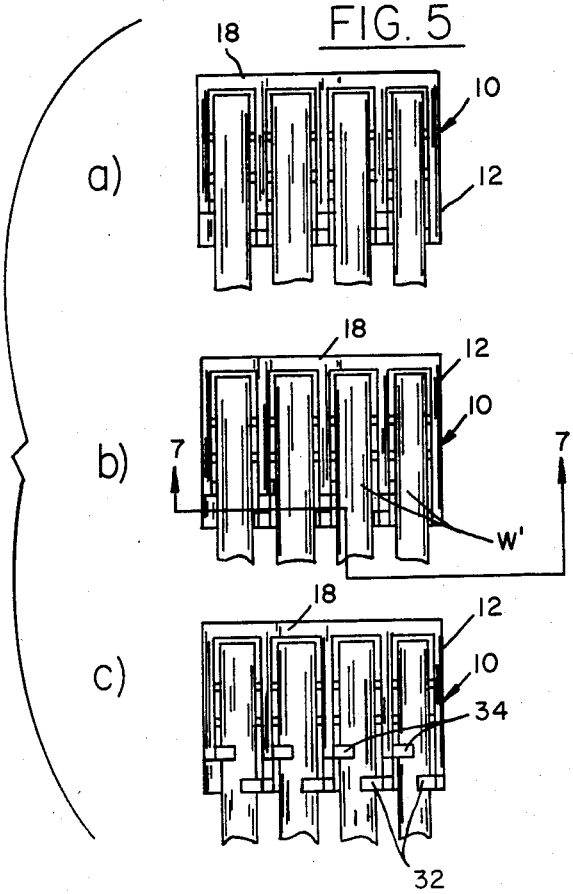
FIGS. 5a–5c are plan views showing the sequence of termination of insulation-clad wires in the connector housing of FIGS. 1 and 2.
Figure 6:
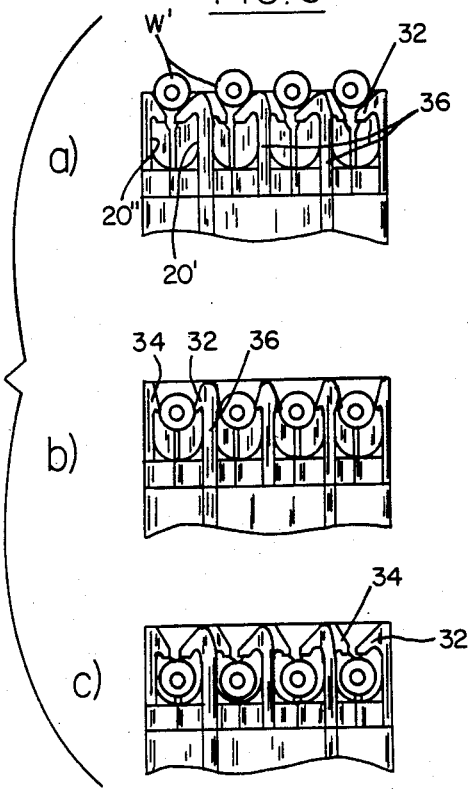
FIGS. 6a–6c are elevational views corresponding to FIGS. 5a–5c, respectively.

FIGS. 5 and 6 show a connector according to the present invention, in views corresponding to those of FIGS. 3 and 4, respectively. FIGS. 5a–5c show a sequence of wire termination in a connector 10. As indicated in a comparison of FIGS. 4 and 6, a larger size of wire can be accommodated in the connector of the present invention wherein insulation-clad wire "W'" can have a diameter corresponding to the distance between opposed interterminal wall surfaces 20', 20''. With reference to FIGS. 7, *6a*, *6b* (and FIGS. *5a*, *5b*), mass insertion of maximum-size wires "W'" is possible since first fingers 32 are independently moveable with respect to second fingers 34. The most critical time during mass termination is when all wires and all resilient fingers are laterally aligned, as indicated in FIGS. 7, *4b*, and *6b*. In the present invention, any restriction owing to the thickness of resilient finger 34 is compensated in the housing 12, by an opposite direction of the opposing inter-terminal wall 56.

Further, wires of very small size can be effectively captivated in the strain relief means of the present invention. When accommodating very small wires, the first strain relief fingers 32 can be elongated so as to extend and even overlap, its opposing finger 34. By skillful limiting of the amount of axial offset between fingers 32, 34, wires of very small sizes can be effectively retained in housing 12. Further, this same housing 12 can, without modification, accommodate a maximum-size wire, owing to the independent movement of first resilient fingers 32.

In the preferred embodiment, drawn in FIG. 7, first fingers 32 can be deflected or displaced into alignment with inter-terminal wall surface 20', and even beyond, so that the finger 32 of one wire receiving region is aligned with the finger 34 of an adjacent wire receiving region, in the direction of wire axis, thereby presenting an optimally compact configuration.

I claim:

1. A multicircuit electrical connector for mass terminating a plurality of insulation-clad wires, said connector including an integrally molded dielectric housing with a plurality of terminal-receiving cavities formed therein, a wall adjoining said cavities, and wire-receiving regions formed in said wall, each for receiving a wire moved laterally of its axis into a respective cavity, Terminals mounted in the cavities, each having an insulation displacing wire termination portion adapted for making electrical connection with said wires, and a plurality of strain relief means formed in the housing wall, one adjacent each wire-receiving region, each including first and second laterally-opposed wire-retaining fingers extending into a wire-receiving region and defining a constricted wire-receiving entrance thereof, said fingers being resiliently moveable to allow a wire to pass through said entrance into the cavity, the first fingers of one wire-receiving region being adjacent the second fingers of an adjacent wire-receiving region, the improvement in said strain relief means wherein:

each said first finger is offset from said second finger along a wire axis; and means mounting each said first finger to said wall for independent movement relative to an immediately adjacent second finger of an adjacent wire-receiving region, as said wires are mass terminated to said terminals.

2. The connector of claim 1 wherein said first fingers are formed at the free ends of a corresponding number of resilient beams extending parallel to said wall a spaced-apart distance therefrom.

3. The connector of claim 2 wherein said second fingers lie in a first plane and said first fingers lie in a second plane spaced from said first plane.

4. The connector of claim 1 further including at least one interterminal wall having opposing sides, each partially defining adjacent cavities, the second finger associated with one cavity depending from one side, and the other side comprising a wire-engaging surface cooperating with an adjacent cavity.

5. The connector of claim 4 wherein the first finger of one wire-receiving region is axially aligned with an inter-terminal wall forming said one and said adjacent wire-receiving regions.

6. The connector of claim 5 further including wire-receiving shelf portions laterally extending from a beam associated with one wire-receiving region, toward an adjacent wire-receiving region and cooperating with the first finger of said adjacent wire-receiving region.

7. The connector of claim 6 wherein said first fingers extend laterally from said beams in a direction opposite to said shelf portion.

* * * * *